United States Patent [19]

Dahlin

[11] 3,937,169

[45] Feb. 10, 1976

[54] ARRANGEMENT IN CARGO HATCHES ON SHIP WEATHER DECKS

[75] Inventor: Carl Erik Ingemar Dahlin, Partille, Sweden

[73] Assignee: von Tell Trading Co. AB, Molndal, Sweden

[22] Filed: Aug. 19, 1974

[21] Appl. No.: 498,378

[30] Foreign Application Priority Data

Aug. 20, 1973 Sweden ..... 7311290

[52] U.S. Cl. ..... 114/202; 114/201 R

[51] Int. Cl.[2] ..... B63B 19/12

[58] Field of Search ..... 114/201 R, 202, 201 A; 160/188, 193, 202; 52/71

[56] References Cited

UNITED STATES PATENTS

| | | | |
|---|---|---|---|
| 2,774,420 | 12/1956 | Lecomte | 114/201 R |
| 2,869,502 | 1/1959 | Stransky | 114/202 |
| 3,238,995 | 3/1966 | Bonzer | 160/188 |
| 3,811,396 | 5/1974 | Wessel et al. | 114/201 R |

FOREIGN PATENTS OR APPLICATIONS

| | | | |
|---|---|---|---|
| 937,693 | 7/1955 | Germany | 114/202 |

*Primary Examiner*—George E. A. Halvosa
*Assistant Examiner*—Charles E. Frankfort
*Attorney, Agent, or Firm*—Harness, Dickey & Pierce

[57] ABSTRACT

An arrangement permitting cargo hatches consisting of one or several sections and moveable in the transverse or longitudinal direction of the ship to be stowed alongside the frame surrounding the hatchway so as to be out of the way during loading and unloading operations. The arrangement includes a ramp on which the hatch sections are supported while being moved, the ramp being arranged for swinging movement so as to position the hatch sections vertically adjacent the external face of the frame and below the upper level of the frame.

13 Claims, 9 Drawing Figures

ARRANGEMENT IN CARGO HATCHES ON SHIP WEATHER DECKS

BACKGROUND OF THE INVENTION

It is customary to stow loads on top of the cargo hatches on the weather deck of ships and to cover the loads with a tarpaulin. In hard weather, waves will wash over the ship and the load on the hatches might be damaged.

SUMMARY OF THE INVENTION

The purpose of the present invention is to remedy this drawback. This is achieved in accordance with the invention in that the frame surrounding the hatchway on weather decks is made sufficiently high to hold the loads within the cargo space, whereby at the same time space is created wherein the cargo hatch sections covering the hatchway may be stowed vertically on the outside of the frame when removed from the hatchway and displaced, e.g. transversally across the ship. In this position, they are completely out of the way during loading and unloading.

It is characteristic of the invention that the cargo hatch section or sections are displaceably mounted for movement laterally onto a ramp which is arranged to be moved together with the hatch section or sections, turned vertically upwards, down along the outside of the frame by means of a preferably hydraulically operated mechanism.

BRIEF DESCRIPTION OF THE DRAWINGS

The invention will be described more in detail in the following with reference to the accompanying, partly diagrammatical drawings illustrating three various embodiments of the invention. In the drawings.

DETAILED DESCRIPTION OF PREFERRED EMBODIMENTS

Figures 1, 2:
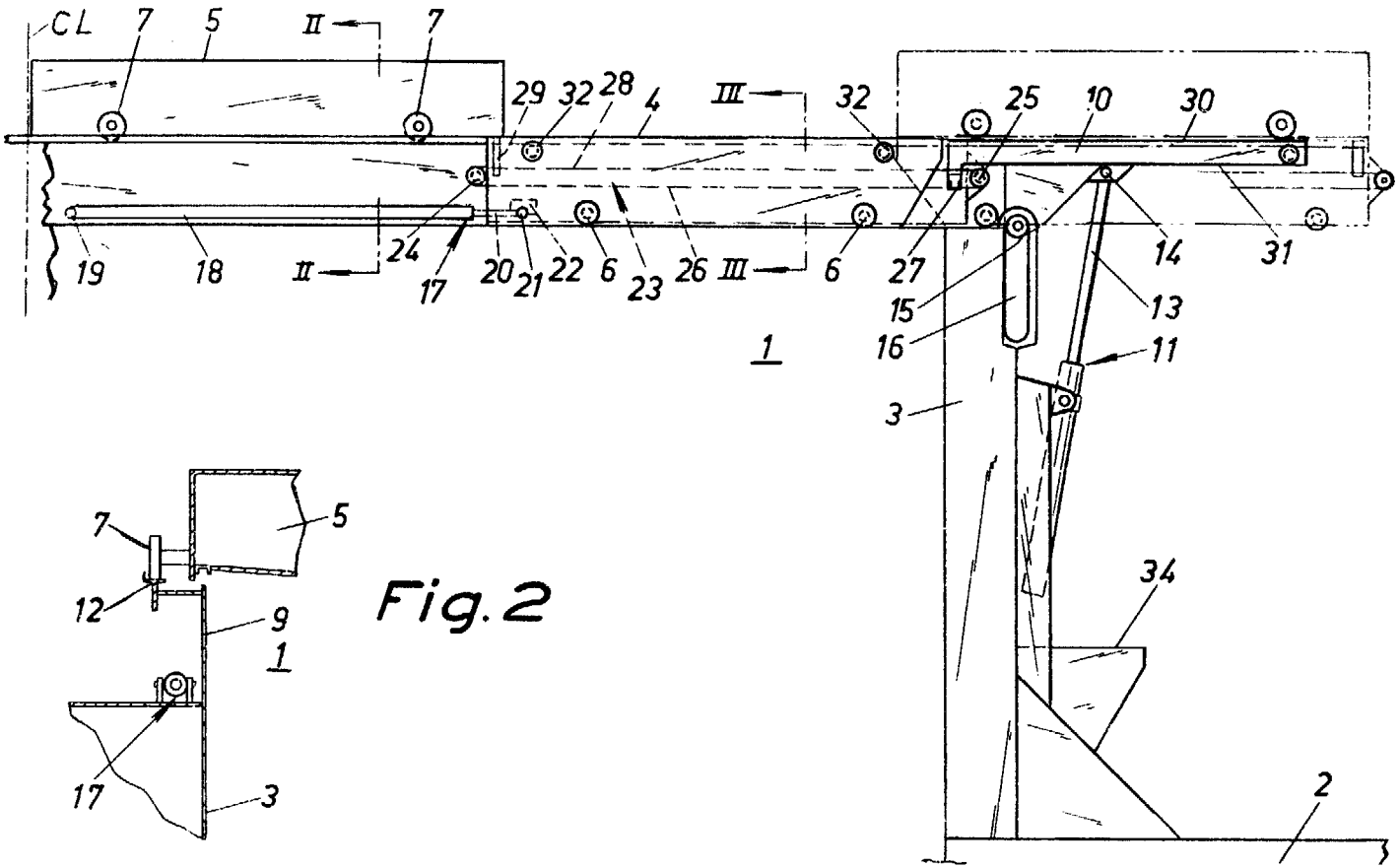
FIG. 1 shows a vertical cross-section through one side of a cargo hatchway on a weather deck of a ship and two cargo hatch sections covering the hatchway, the covering sections being illustrated in their closed position.
FIG. 2 is a cross-sectional view along line II—II of FIG. 1, through one frame side.

The cargo space 1 illustrated in the drawings has a frame 3 which projects from the weather deck 2 to a considerable height, e.g. in the range of between 7 and 9 meters. In any case, the height should exceed the width of the cargo hatch sections 4, 5 covering the cargo space (or, in case of sections of various widths, the widest one thereof). In the embodiment illustrated in FIG. 1 only two cargo hatch sections 4, 5 are shown as the cross-sectional view illustrated is taken only through one half of the cargo space to the righthand side of the ship center line CL. One has to imagine that the second half of the space is a mirror image of the half illustrated in FIG. 1.

Figures 3, 4:
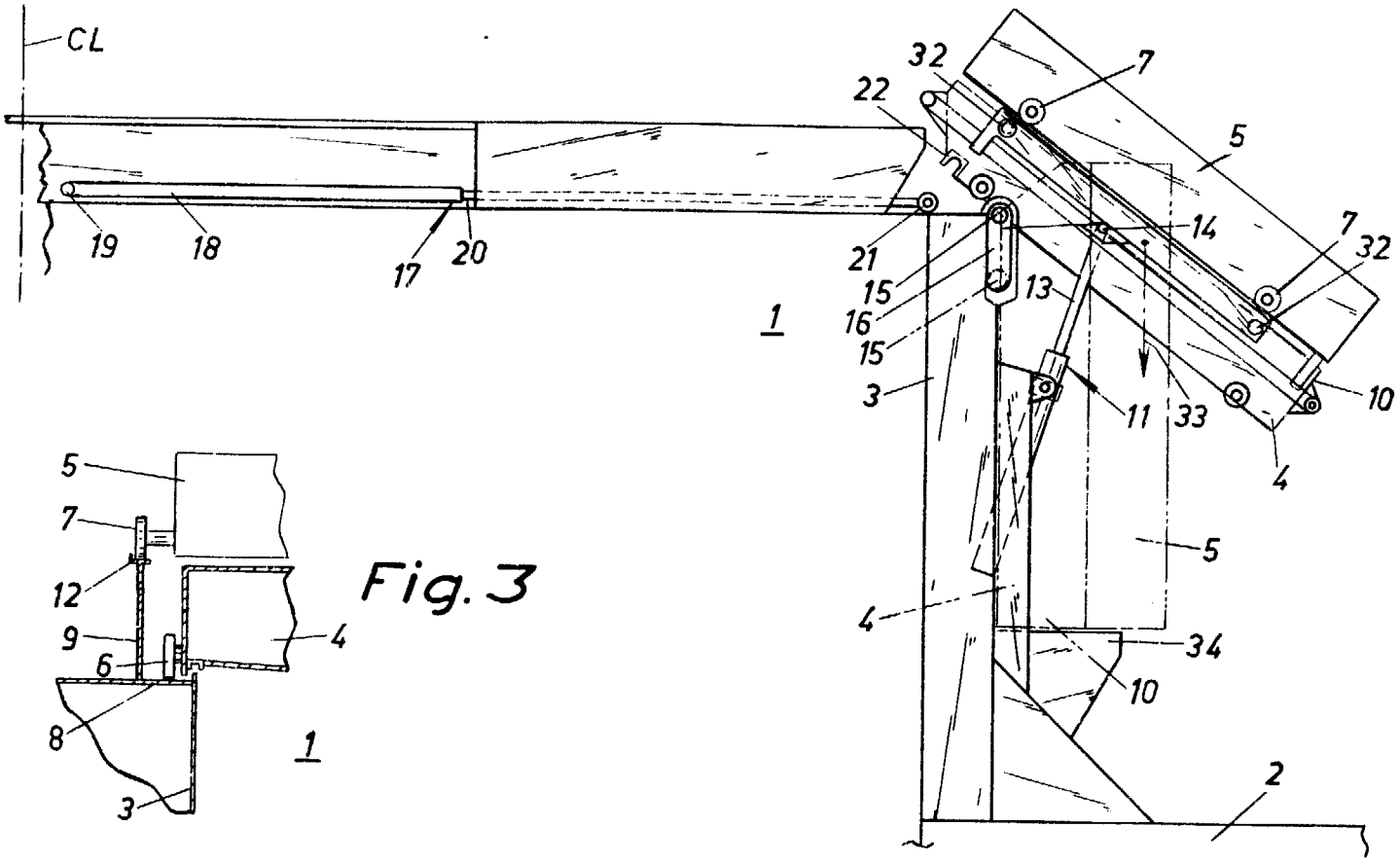
FIG. 3 is a similar cross-sectional view along line III—III of FIG. 1.
FIG. 4 is a cross-sectional view similar to FIG. 1 but showing various stages of the hatch removal procedure.

The cargo hatch sections 4, 5 are each one provided with two pairs of support rollers 6 and 7, as appears from FIG. 3, rollers 6 running on the upper portion 8 of the frame 3 whereas rollers 7 run at a higher level on a longitudianlly extending rail 9 provided on the frame.

On the outer face of the portion of the frame 3 extending in the fore-and-aft direction is arranged a ramp 10 in the form of an elevator carriage and a hydraulically operated unit 11 is provided to swing the ramp to a horizontal position (FIG. 1), level with the plane of rolling 12 of the rail 9. The upper end of the piston rod 13 of the hydraulic unit is articulated to the ramp 10 by means of pivot pin 14. The ramp is provided with guide rollers 15 running in one vertical guide slot 16 each, formed in the frame 3, one at the fore end and one at the aft end of the ramp 10 (only one shown in the drawings).

The mechanism for mounting and removing the cargo hatch sections incorporates a hydraulic unit 17 comprising a cylinder 18 which is journalled at its inner end about a pivot pin 19 for pivotal movement relative to the frame 3 and the piston rod 20 of which is provided with a follower roller 21 or similar means the shaft of which may be brought into releasable engagement with a follower fitting 22 on the outer cargo hatch section 4. The latter is additionally provided with a continuous chain 23 running over two pulleys 24 and 25 on the cargo hatch section. The lower run 26 of the chain 23 is secured to an arm 27 or similar means on the inner edge of the ramp 10 and the upper run 28 of the chain is secured to an arm 29 or similar means on the inner cargo hatch section 5.

The ramp 10 is formed with an upper runway 30 for the runner rolls 7 of the inner hatch section 5 and with a lower runway 31 for the support rollers 32 on the outer hatch section 4.

Upon cargo hatch removal, when the ramp 10 is initially swung by means of the hydraulic unit 11 up to horizontal position (FIG. 1), a pressure is applied in the cylinder 18 whereby the outer hatch section 4 is displaced to the right by the follower roller 21 out onto the ramp 10. At the same time, the chain 23 is forced to run in the clockwise direction over the pulleys 24, 25 and as a result, the inner cargo hatch section 5 is forced onto the ramp 10 at a speed double that of cargo hatch section 4 (indicated in dash-and-dot lines in FIG. 1). Upon reduction of the pressure of the hydraulic unit 11, the ramp 10 together with the hatch sections 4 and 5 is swung about the guide rollers 15. The latter remain at the upper end of the guide slot 16 during the ramp swinging movement as the pivot pin 14 is positioned at a point to the left of the plumb-line 33 from the centre of gravity of the ramp 10 and the cargo hatch sections 4 and 5. Only when the ramp 10 together with the hatch sections thereon are swung into vertical position, is the ramp moved to the position illustrated in FIG. 4 in dash-and-dot lines while guided by the guide rollers 15, in which lower position the ramp 10 and the hatch sections 4, 5 are supported with their lower ends resting on a bracket 34 provided at the outer face of the frame 3. Hatch mounting of course takes place in the reverse order. The ramp 10 with cargo hatch cover sections 4, 5 thereon are displaced by the hydraulic unit 11, first in a direction straight vertically upwards and then, when the guide rollers 15 have reached the upper end of the slit 16, they are swung to their horizontal position (FIG. 1). In this position, the follower fitting 22 engages the shaft of the follower roll 21 and the hydraulic unit 17 then returns the cargo hatch sections 4, 5 to their original position (FIG. 1). The ramp 10 may then be swung by the hydraulic unit 11 down to vertical position alongside the outer face of the frame 3.

The tightening and battening-down mechanisms for the cargo hatch sections 4, 5 are not shown or described here as any suitable prior-art construction may be used therefor.

Figure 5:
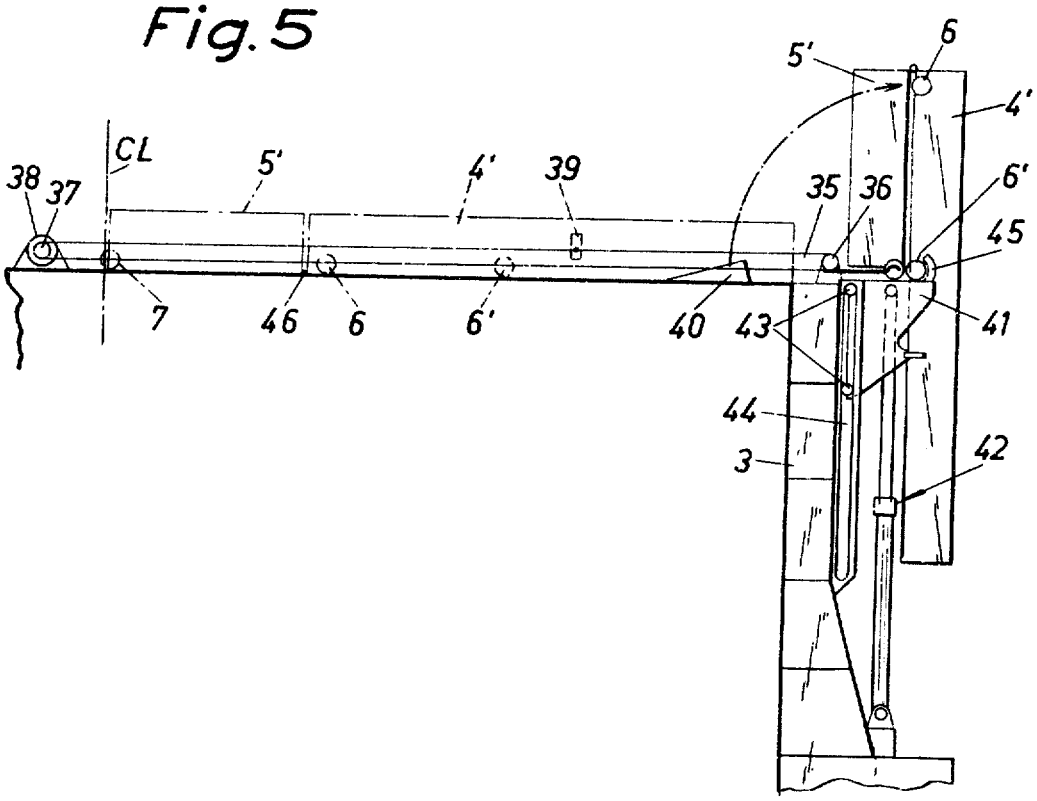
FIGS. 5 and 6 are vertical cross-sectional views through one side of a hatchway having a mechanism for mounting and removal of hatch sections in accordance with another embodiment of the invention.
Figure 6:
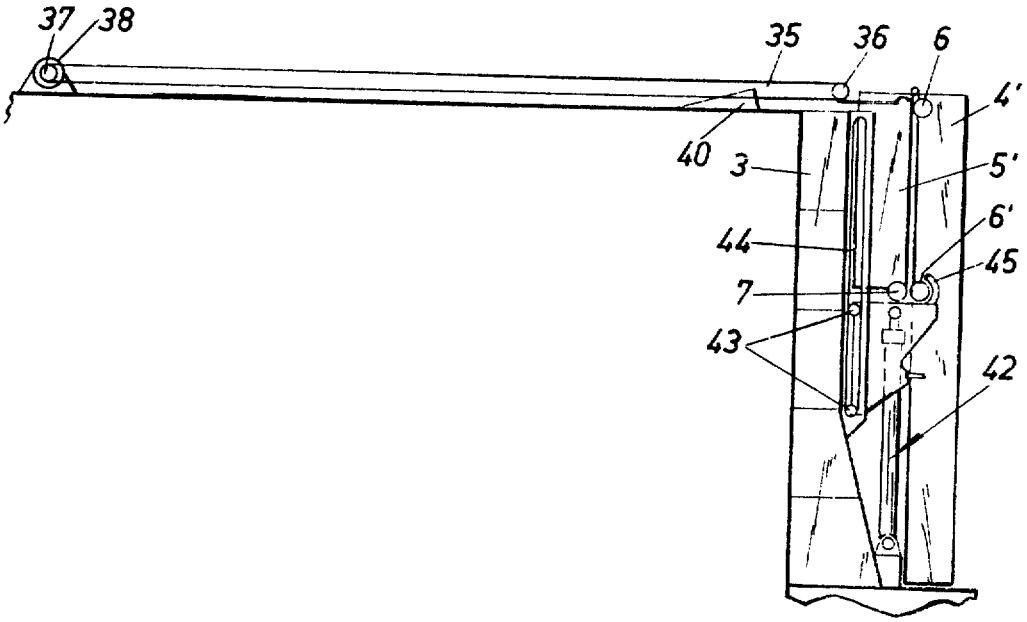

In accordance with the embodiment illustrated in FIGS. 5 and 6 two cargo hatch sections of different sizes are used for each cargo space side, i.e. one outer larger section 4' and an inner, smaller section 5'. The outer cargo hatch section 4' is provided close to its inner edge with two support rollers 6 and, closer to its centre, with two support rollers 6'. The inner section 5' is provided with a pair of support rollers 7 positioned close to the inner section edge. At its upper portion the hatchway frame 3 presents two pairs of continuous chains 35 each one of which runs over two pulleys 36, 37 the latter one of which is driven by a motor 38. The chains, one at each end of the hatch sections 4', 5' cooperate with follower fitting 39 provided on the outer hatch section 4'. At its upper portion the frame 3 further presents sloping ramps 40 along which the rollers 6 run in an upwards direction upon hatch removal. Also this mechanism includes a ramp 41 formed as an elevator carriage which is displaceable in the vertical direction by means of a hydraulic unit 42 while being guided by a pair of rollers 43 in vertical guide slots 44 formed on the external face of the frame 3. The ramp 41 is provided with stopper shoulders 45 at its outer edge.

Upon removal of the cargo hatches, the chains 35 are driven in the clock-wise direction and in their movement they bring with them the outer hatch section 4' and the inner section 5' which is united with the outer section by means of pivot pins 46. When the support rollers 6 run up the sloping ramps 40, the cover sections will be positioned at an angle relative to one another and, after abutment of the support rollers 6' against the shoulder 45, the two cargo hatch sections 4' and 5' will be completely folded together and assume a vertical position. The hydraulic unit 42 lowers the ramp 41 together with the hatch sections 4' and 5' thereon to the position illustrated in FIG. 6. In this position hatch sections 4' and 5' have their upper edges essentially level with the upper edge of the frame 3 and the hatches thus are completely out of the way during loading and unloading operations. Hatch section mounting naturally takes place in the opposite direction, the inner hatch section 5', after the ramp 41 has reached its upper position illustrated in FIG. 5, being removably connected to the upper run of the chains 35 which thereafter pull back the hatch sections to their original position indicated in dash-and-dot lines in FIG. 5.

Figure 7:
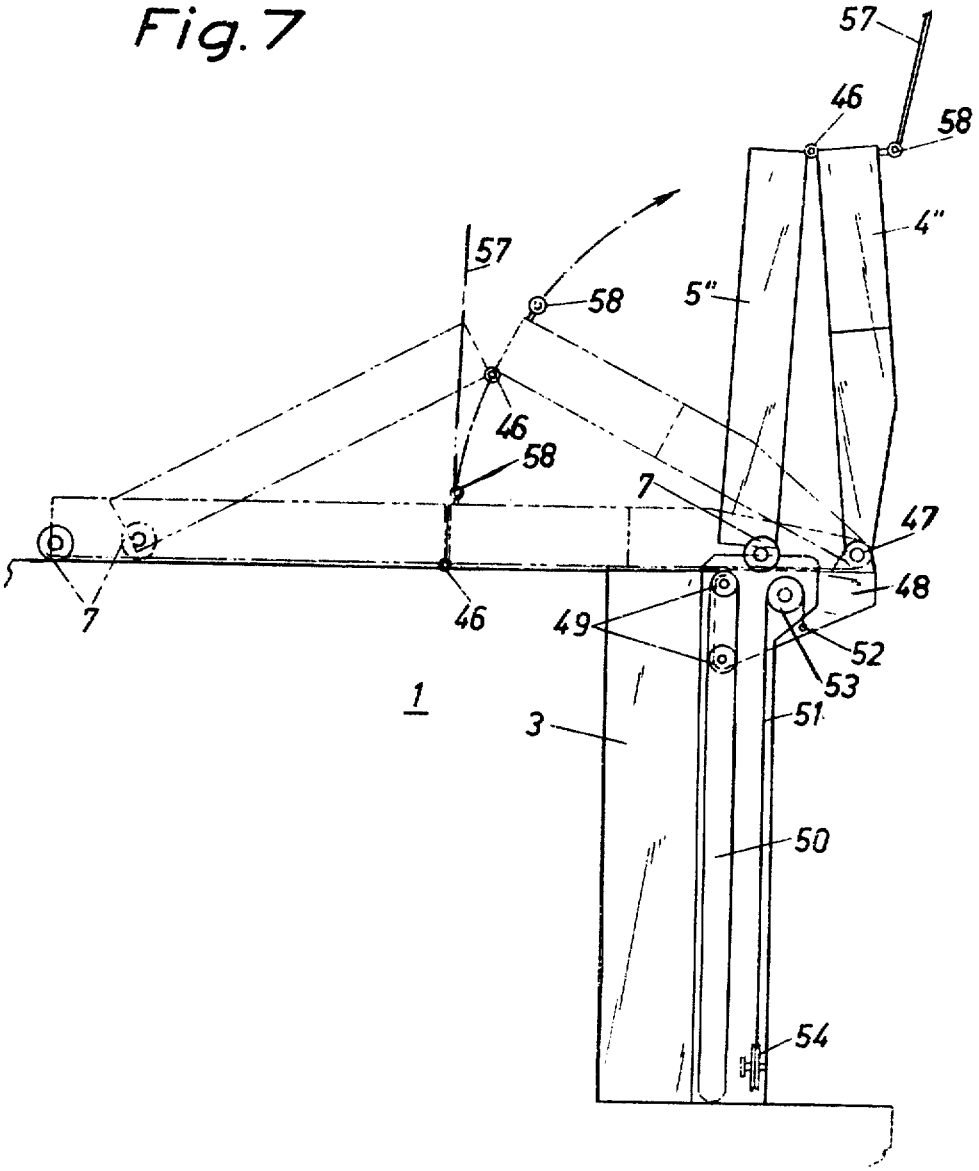
FIGS. 7 and 8 are similar cross-sectional views but illustrate a mechanism for hatch section mounting and removal in accordance with a further embodiment of the invention.
Figure 9:
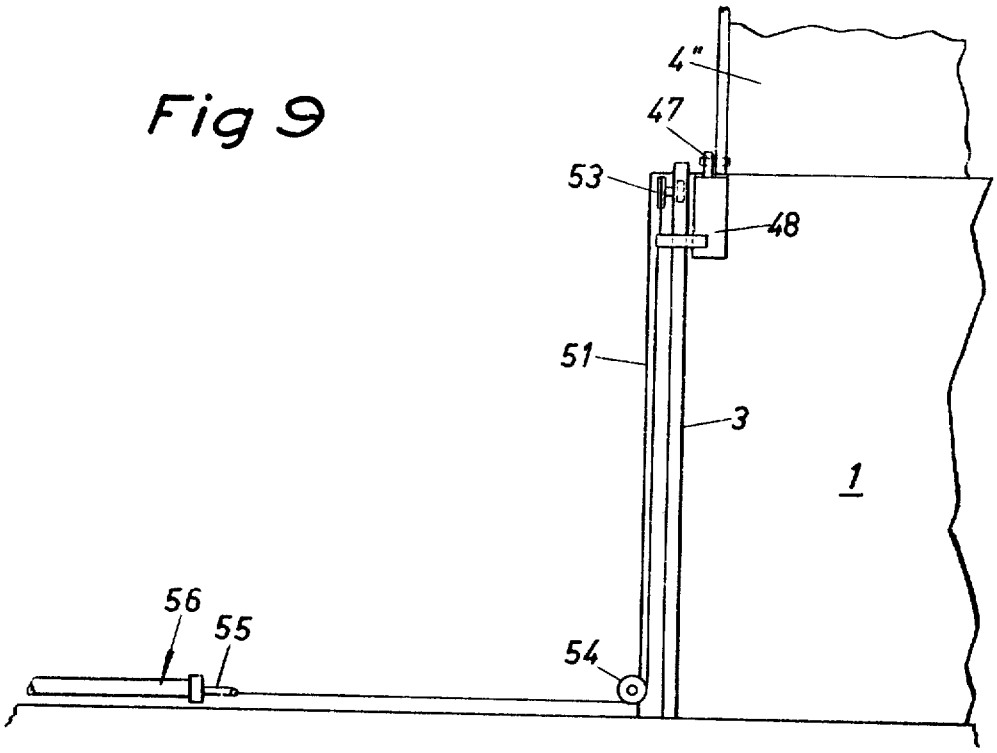
FIG. 9 is a side view of this mechanism.
Figure 8:
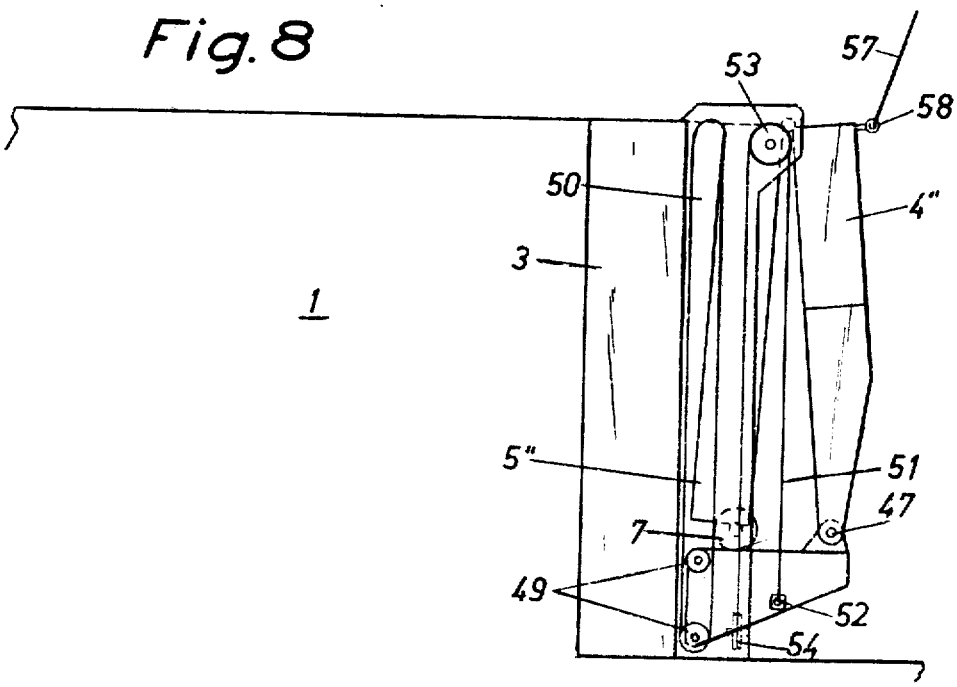

In accordance with the embodiment shown in FIGS. 7 to 9 the outer cargo hatch section 4'' has its outer edge pivotally mounted about a shaft 47 on the outer edge of a ramp 48 formed as an elevator carriage. Pivot pins 46 articulate this hatch section to the inner hatch section 5'', the inner end of which provided with support rollers 7. The ramp 48 is provided with two pairs of guide rollers 49 which run in vertical guide grooves 50 provided on the external face of the frame 3. The ramp 48 is displaceable in the vertical direction by means of traction wires 51 one end 52 of which is attached to the ramp and runs over pulleys 43 at the upper portion of the frame 3 and pulleys 54 at the lower portion of the frame whereas the opposite end is attached to the piston rod 55 of a hydraulic unit 56.

Hatch removal is effected with the aid of a wire 57 drawn off from a winch (not illustrated) and secured at 58 to the outer hatch section 4'' (or inner section 5''). By means of this wire 57, the hatch sections 4'', 5'' are swung into the position illustrated in FIG. 7 by continuous lines. Together with the ramp 48 they are thereafter lowered by the hydraulic unit 56 to the position shown in FIG. 8 externally of the frame 3. Hatch mounting of course takes place in the opposite direction.

The embodiments as shown and illustrated are to be regarded as examples only and both the arrangement and configuration of the cargo hatch sections and the mechanism for hatch removal and mounting may be constructively altered in a variety of ways within the scope of the appended claims. The invention is applicable also to hatch sections of the kind which are interconnected by means of chains or articulated rods. In the latter case, the hatch sections are arranged to run onto the ramp serving as an elevator carriage where they are swung into vertical position, one at a time. The ramp is then preferably displaced in a direction obliquely downwards, inwards towards the frame, either guided by rollers positioned in oblique guide slits or displaced by parallel support arms the inner end of which is articulated to the frame and the outer end to the ramp.

A feature common to all the embodiments described in the aforegoing is that the ramp should be provided with means to lock the latter to the frame in the lower ramp position and with means to lock the cargo hatch sections to the ramp in their stowed-away, vertical position.

The invention has been described above when applied to cargo hatch sections which are moveable in a transverse ship direction. It may, however, be applied also to hatch sections which are moveable in the longitudinal direction of the ship, for instance in cases where on the weather decks high frames alternate with lower frames around the hatchways, or in all cases when stowing of the hatch sections in a vertical direction between high frames is at all possible.

What I claim is:

1. An improvement in cargo hatches for ship weather decks including a frame surrounding the hatchway and extending above the deck, the improvement comprising a ramp juxtaposed to one side of said frame, means for laterally moving a cargo hatch section onto said ramp, and means for displacing said ramp together with said cargo hatch section for storing said cargo hatch section in a vertical position adjacent said one side of said frame and below the upper level of said frame.

2. A cargo hatch as set forth in claim 1 further including means for pivotally supporting said ramp about a horizontal axis and means for swinging said ramp and the associated cargo hatch section into a vertical position adjacent said one frame side.

3. An arrangement as claimed in claim 2, wherein the means for pivotally supporting said ramp comprises a slide guilding means provided on the external face of said frame, and rollers on said ramp arranged, to be displaced in said slide guiding means.

4. An arrangement as claimed in claim 2, comprising two cargo hatch sections, at least one chain on the outer one of said cargo hatch sections, pulleys over which said chain is arranged to run, the inner one of said cargo hatch sections being connected to said chain, and a unit to displace said outer cargo hatch section together with the inner one onto said ramp to a position externally of said frame.

5. An arrangement as claimed in claim 4, wherein said inner cargo hatch section is arranged to move at a speed double that of said outer section.

6. An arrangement as claimed in claim 1, comprising at least one chain on said cargo hatch section, pulleys over which said chain is arranged to run, said cargo hatch section being connected to said chain, and a unit to displace said cargo hatch section onto said ramp to a position externally of said frame.

7. An arrangement as set forth in claim 6 further including a second cargo hatch section operatively associated with the first mentioned cargo hatch section, said cargo hatch sections comprising an inner section and an outer section.

8. An arrangement as claimed in claim 7, wherein said means to displace said outer cargo hatch section onto said ramp is a piston-and-cylinder unit, a coupling means provided on the piston rod of said unit to bring about disengagement between said rod and said outer cargo hatch section upon swinging motion of said section from its horizontal to its vertical position, and re-engagement between said rod and cargo hatch section upon swinging motion of said section in the opposite direction.

9. An arrangement as claimed in claim 7, wherein said inner cargo hatch section is arranged to move at a speed double that of said outer section.

10. An arrangement as claimed in claim 1, wherein said ramp is vertically moveable on the external face of said frame, a shaft on said ramp, said cargo hatch section having its outer longitudinal edge pivotally mounted about said shaft.

11. An arrangement as claimed in claim 1, including two hatch sections pivoted together, rollers supporting the outer hatch section, the improvement comprising an innermost pair of said support rollers positioned close to the inner edge of said outer hatch section, a pair of sloping ramp means, said ramp means positioned in opposite relationship on said hatch frame, said innermost pair of support rollers arranged, upon hatch removal, to run up along said pair of sloping ramp means so as thereby to urge the point of articulation between said outer hatch section and the subsequent section in the inwards direction, upwards and thus position these two hatch sections at an angle relative to one another said ramp being vertically moveable alongside the external face of said frame, a second pair of rollers positioned closer to the outer edge of said outer cargo hatch section, and stopper means on said vertically moveable ramp to limit the displacement of said second pair of rollers.

12. An arrangement as claimed in claim 1, wherein the height of said hatch frame above the weather deck is essentially equal to the width of the hatch section.

13. An arrangement as claimed in claim 1, wherein the height of said hatch frame above the weather deck is in excess of the width of the hatch section.

* * * * *